US008210335B2

(12) United States Patent
Chang

(10) Patent No.: US 8,210,335 B2
(45) Date of Patent: Jul. 3, 2012

(54) BILL AND COIN ACCEPTOR

(75) Inventor: Yu-Tsung Chang, Taipei (TW)

(73) Assignee: International Currency Technologies Corporation, Taipei (TW)

( * ) Notice: Subject to any disclaimer, the term of this patent is extended or adjusted under 35 U.S.C. 154(b) by 166 days.

(21) Appl. No.: 12/662,700

(22) Filed: Apr. 29, 2010

(65) Prior Publication Data

US 2011/0266113 A1 Nov. 3, 2011

(51) Int. Cl.
*G07F 1/00* (2006.01)
*G07F 1/02* (2006.01)
*G07F 7/04* (2006.01)

(52) U.S. Cl. ..... 194/206; 194/351

(58) Field of Classification Search ..... 194/205–207, 194/229, 350, 351; 235/379; 902/17, 23
See application file for complete search history.

(56) References Cited

U.S. PATENT DOCUMENTS 4,850,468 A * 7/1989 Kobayashi et al. ..... 194/207
6,283,268 B1 * 9/2001 Fletcher et al. ..... 194/344
6,499,581 B2 * 12/2002 Yoshida et al. ..... 194/318
7,641,037 B2 * 1/2010 Nireki ..... 194/207

* cited by examiner

*Primary Examiner* — Mark Beauchaine
(74) *Attorney, Agent, or Firm* — Bacon & Thomas, PLLC

(57) ABSTRACT

A compact size bill and coin acceptor for use in an automatic vending machine or game machine is disclosed to include a face panel having a bill slot, a coin slot and a coin-return slot, a first housing that comprises a bill passage, a power drive mechanism adapted for transferring an inserted bill from the bill slot through the bill passage and a bill recognition module adapted for recognizing the authenticity and value of an inserted bill, and a second housing that comprises a coin passage in communication with the coin slot, a coin sensor module and an optical recognition device adapted for sensing the authenticity and value of an inserted coin, a driven gear set for assisting transfer of an inserted bill through the bill passage, a coin-return passage in communication with the coin-return slot and a gate movable by an electromagnetic valve to open the passage between the coin passage and the coin-return passage.

13 Claims, 8 Drawing Sheets

BILL AND COIN ACCEPTOR

BACKGROUND OF THE INVENTION

1. Field of the Invention

The present invention relates to bill and coin receiving technology and more particularly, to a bill and coil acceptor, which has a compact size for easy installation in a host with less space occupation, for enabling the host to accept bills and coins.

2. Description of the Related Art

Following fast development of modern technology, the pace of every day life has speeded up everything from faster fast food in our own neighborhood to instant communication across the world. Nowadays, non-shop business has become popular, and various automatic vending machines (card dispensers, ticket vending machines, coin exchanging machines, etc.) are used everywhere to sell different products without serviceman. The use of automatic vending machines creates new marketing routes for the suppliers, saves much labor cost, and brings convenience to consumers.

Further, an automatic vending machine or game machine has a coin acceptor provided on the inside for receiving and verifying coins and providing unmanned services. However, regular automatic vending machines and game machines simply accept coins. However, because coins have small face value and heavy weight characteristics, it is inconvenient to carry a number of coins. If one is going to use an automatic vending machine, game machine or customer inquiry service system without carrying coins, one may have to give use the purchase or inquiry. In order to provide a coin exchange service, the business runner must hire a person to do the work. Hiring an extra person relatively increases the personnel cost. Using a coin exchanger also costs a lot. However, running a non-shop business without providing a coin exchange service will lose many business chances.

A bill acceptor and a coin acceptor may be installed in an automatic vending machine or game machine for enabling the automatic vending machine or game machine to accept bills and coins. However, installing a bill acceptor and a coin acceptor in an automatic vending machine or game machine requires much installation space. Further, the specifications of an automatic vending machine or game machine may have to be modified for accommodating a bill acceptor and a coin acceptor. Modifying the specifications of an automatic vending machine or game machine greatly increases the cost.

Therefore, it is desirable to provide a bill and coin acceptor, which has a compact size and practical for use in an automatic vending machine, game machine or customer inquiry service system.

SUMMARY OF THE INVENTION

The present invention has been accomplished under the circumstances in view. It is the main object of the present invention to provide a bill and coin acceptor, which comprises a first housing that houses a bill-receiving module, a second housing that houses a coin-receiving module, and a face panel fastened to the first housing and the second housing at the front side, constituting a compact size structure for use in an automatic vending machine, game machine or consumer inquiry service system for enabling the machine or system to accept bills and coins.

Further, the face panel has a bill slot, a coin slot and a coin-return slot. The first housing and the second housing define therebetween a bill passage in communication with the bill slot. The first housing comprises a bill passage, a power drive mechanism adapted for transferring an inserted bill from the bill slot through the bill passage and a bill recognition module adapted for recognizing the authenticity and value of an inserted bill. The second housing comprises a coin passage in communication with the coin slot, a coin sensor module and an optical recognition device adapted for sensing the authenticity and value of an inserted coin, a driven gear set for assisting transfer of an inserted bill through the bill passage, a coin-return passage in communication with the coin-return slot and a gate movable by an electromagnetic valve to open the passage between the coin passage and the coin-return passage. Thus, the bill and coin acceptor can be used in a host for unmanned operation and customer self service, saving much the management cost.

Further, after mounting of the face panel on the first housing and the second housing, the compact-sized bill and coin acceptor can then be directly mounted in a host, keeping the bill passage and the coin passage in communication with corresponding internal passages of the host for enabling the host to accept bills and coins. Thus, using the bill and coin acceptor in a host needs not to change the specifications of the host. Therefore, the invention simplifies the design and fabrication of the whole system, and greatly widens its application range.

DETAILED DESCRIPTION OF THE PREFERRED EMBODIMENT

Figure 1:
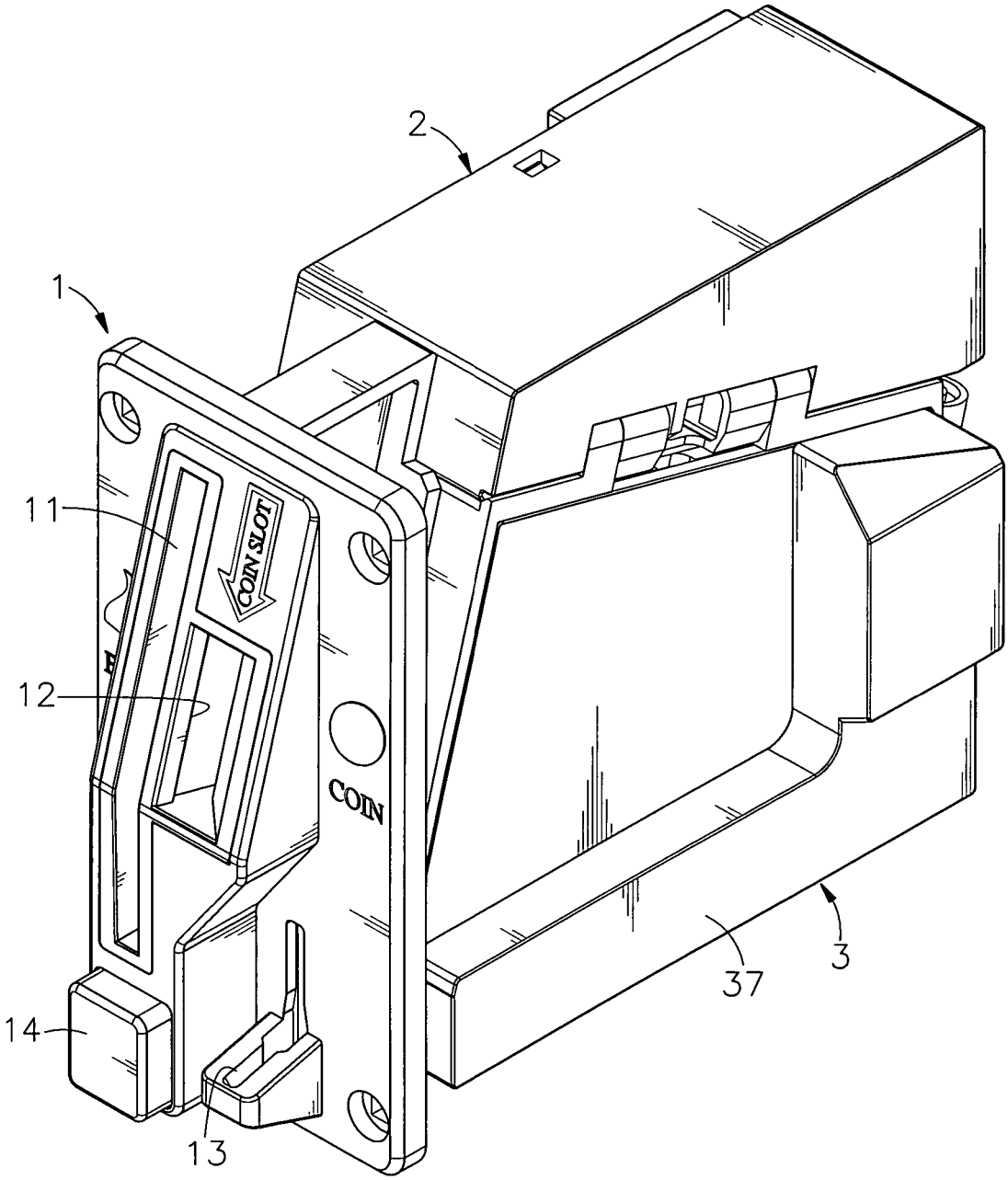
FIG. 1 is an elevational view of a bill and coin acceptor in accordance with the present invention.
Figure 2:
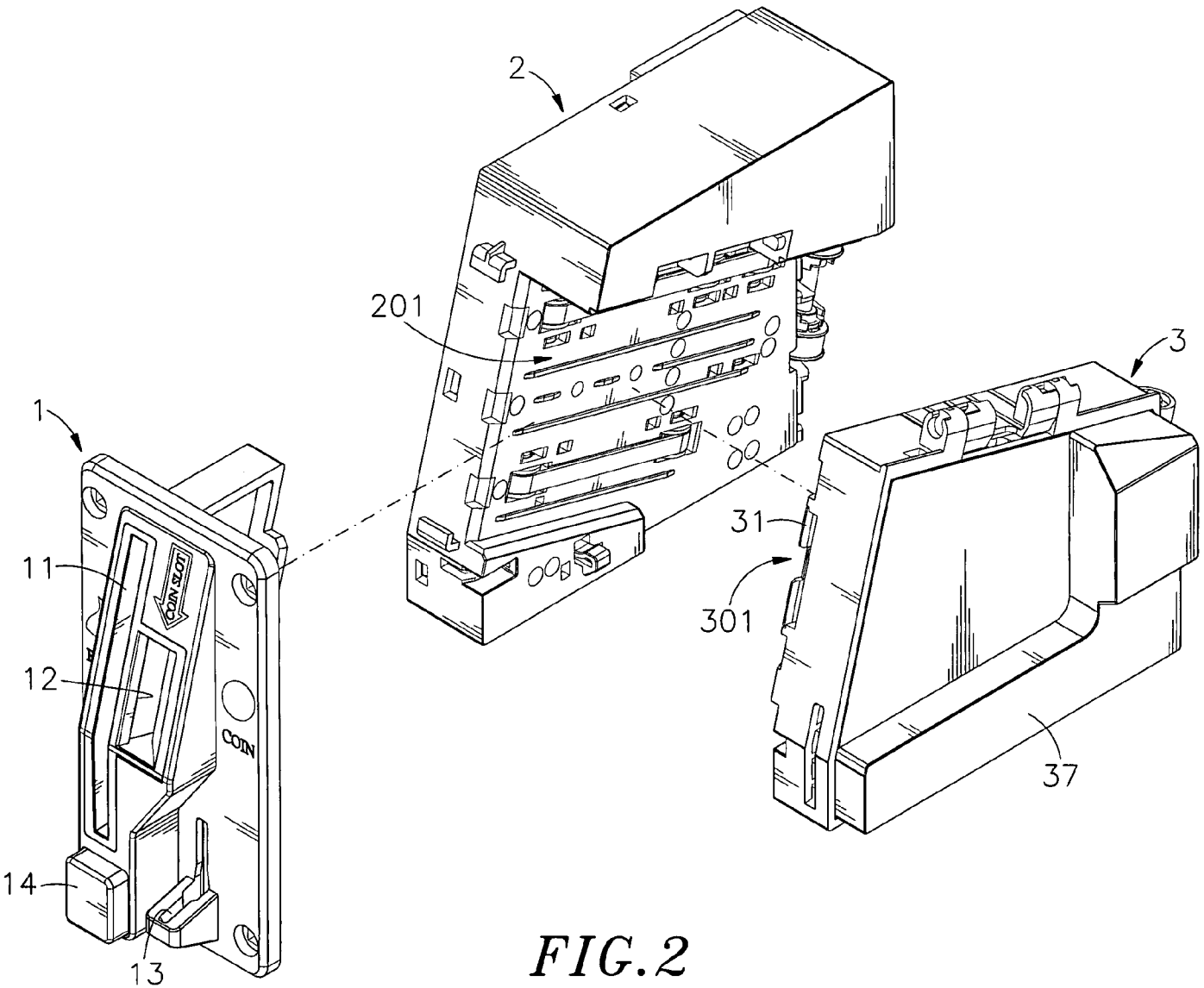
FIG. 2 is an exploded view of the bill and coin acceptor in accordance with the present invention.
Figure 3:
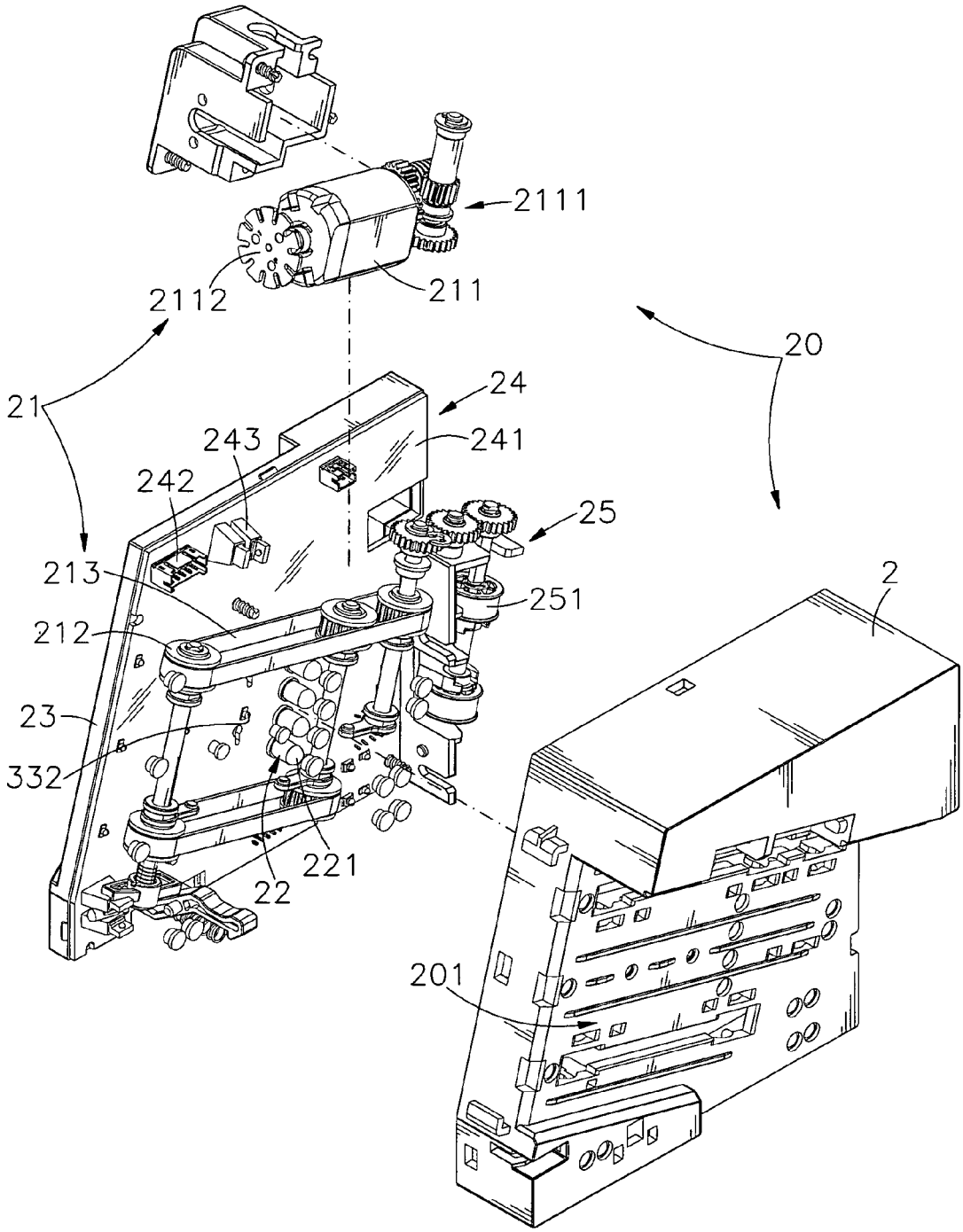
FIG. 3 is an exploded view of the first housing of the bill and coin acceptor in accordance with the present invention.
Figure 4:
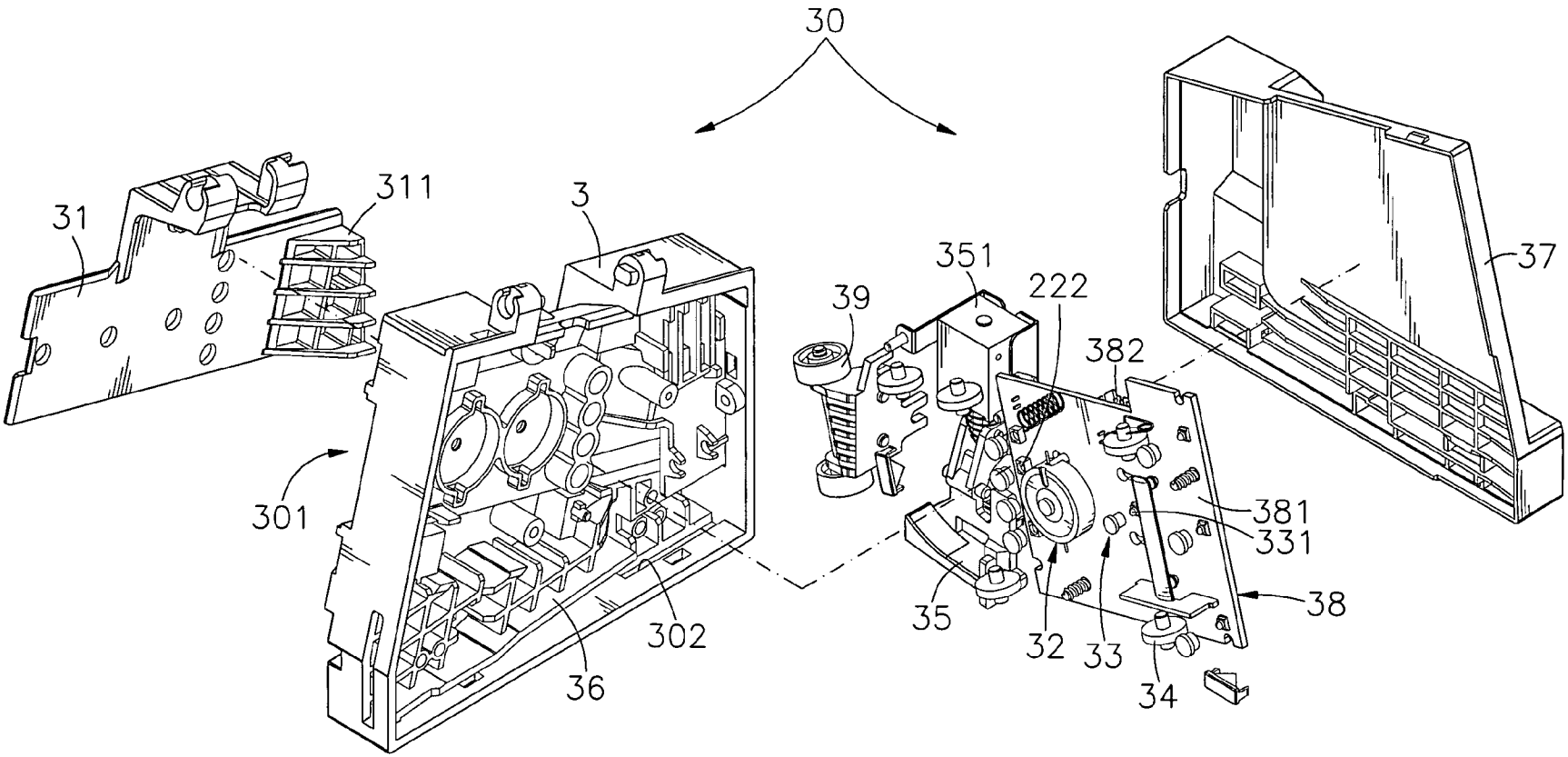
FIG. 4 is an exploded view of the second housing of the bill and coin acceptor in accordance with the present invention.

Referring to FIGS. 1~4, a bill and coin acceptor in accordance with the present invention is shown comprising a face panel 1, a first housing 2 and a second housing 3.

The face panel 1 comprises a bill slot 11, a coin slot 12 cut disposed adjacent to the bill slot 11 at one lateral side, a coin-return slot 13 spaced below the coin slot 12, and a coin-release button 14 arranged at the front side.

The first housing 2 houses a bill-receiving module 20. Further, the first housing 2 has opposing inner and outer lateral sides and defines a bill passage 201 at the inner lateral side. The bill-receiving module 20 comprises a power drive mechanism 21, a bill recognition module 22, an outer cover 23, a circuit module 24 and a bill-expelling mechanism 25. The power drive mechanism 21 comprises a motor 211, a drive gear set 212 coupled to and rotatable by the motor 211, and bill-transfer belts 213 mounted on the drive gear set 212 and rotatable by the drive gear set 212 to transfer bills. The outer cover 23 is covered on the outer lateral side of the first housing 2. The circuit module 24 comprises a circuit board 241 fixedly mounted on the outer cover 23 and received inside the first housing 2. The bill-expelling mechanism 25 is disposed at the rear side of the first housing 2, comprising a bill-expelling wheel set 251.

The second housing 3 is attached to the first housing 2 in proximity to the bill passage 201. Further, the second housing 3 comprises a partition board 31 disposed at an inner lateral side thereof in proximity to the first housing 2 and defining therein a coin passage 301, a coin-receiving module 30, which comprises a coin sensor module 32 and an optical recognition device 33 respectively set in the coin passage 301, a driven gear set 34 arranged at top and bottom sides relative to the coin passage 301 and facing the drive gear set 212 of the power drive mechanism 21, a gate 35 set at a rear bottom side relative to the coin passage 301 and movable between an open position and a close position by an electromagnetic valve 351, a coin-return passage 36 disposed in front of the gate 35, an outer cover 37 covered on an outer lateral side thereof, a circuit module 38 that comprises a circuit board 381 affixed to the inside of the outer cover 37, and an idle wheel set 39 disposed at a rear side thereof corresponding to the bill-expelling wheel set 251.

Figure 8:
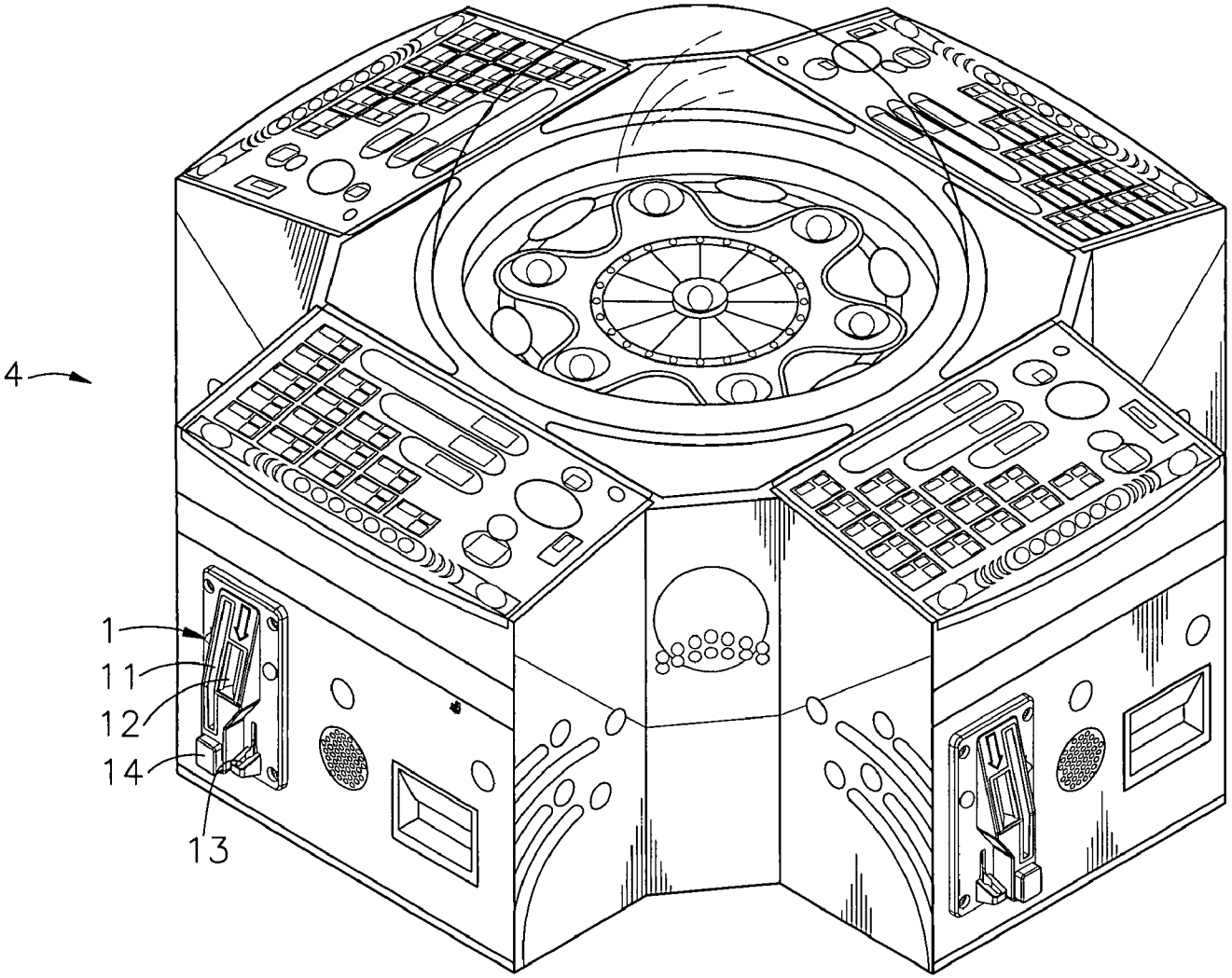
FIG. 8 is an applied view of the present invention, showing the bill and coin acceptor used in a game machine.

During installation, the second housing 3 is hinged to the first housing 2 by a pivot shaft and knuckles (not shown) such that the second housing 3 can be turned relative to the first housing 2 between a close position and an open position, facilitating cleaning, maintenance and troubleshooting. The aforesaid bill passage 201 is defined between the first housing 2 and the second housing 3. After the second housing 3 is closed on the first housing 2, the face panel 1 is fastened to the first housing 2 and the second housing 3 at the front side, keeping the bill slot 11 of the face panel 1 in communication with the bill passage 201 of the first housing 2 and the coin slot 12 and coin-return slot 13 of the face panel 1 in communication with the coin passage 301 and coin-return passage 36 of the second housing 3 respectively. Thereafter, the bill and coin acceptor is inserted into a host 4, and then the face panel 1 is fixedly fastened to the outside wall of the host 4 (see FIG. 8). The host 4 can be an automatic vending machine or game machine. According to the application example shown in FIG. 8, the host 4 is a game machine.

According to conventional designs, a coin acceptor and a bill acceptor are separately installed in an automatic vending machine or game machine for receiving and validating coins or bills respectively. Thus, the coin acceptor and the bill acceptor occupy much the internal space of the automatic vending machine or game machine. The invention integrates a coin acceptor and a bill acceptor into a single unit, saving much the cost and installation space. For example, a conventional bill acceptor is known comprising an upper housing and a lower housing. The lower housing houses a transmission mechanism, a recognition module, an anti-theft gate and power means. Thus, the lower housing has little extra space for use. However, the upper housing simply carries a driven wheel set or transmission belt mechanism for forward/backward transfer of bills. Thus, the upper housing has much internal space left vacant for utilization. Therefore, integrating a bill acceptor and a coin acceptor into one single unit greatly saves the installation space.

Figure 5:
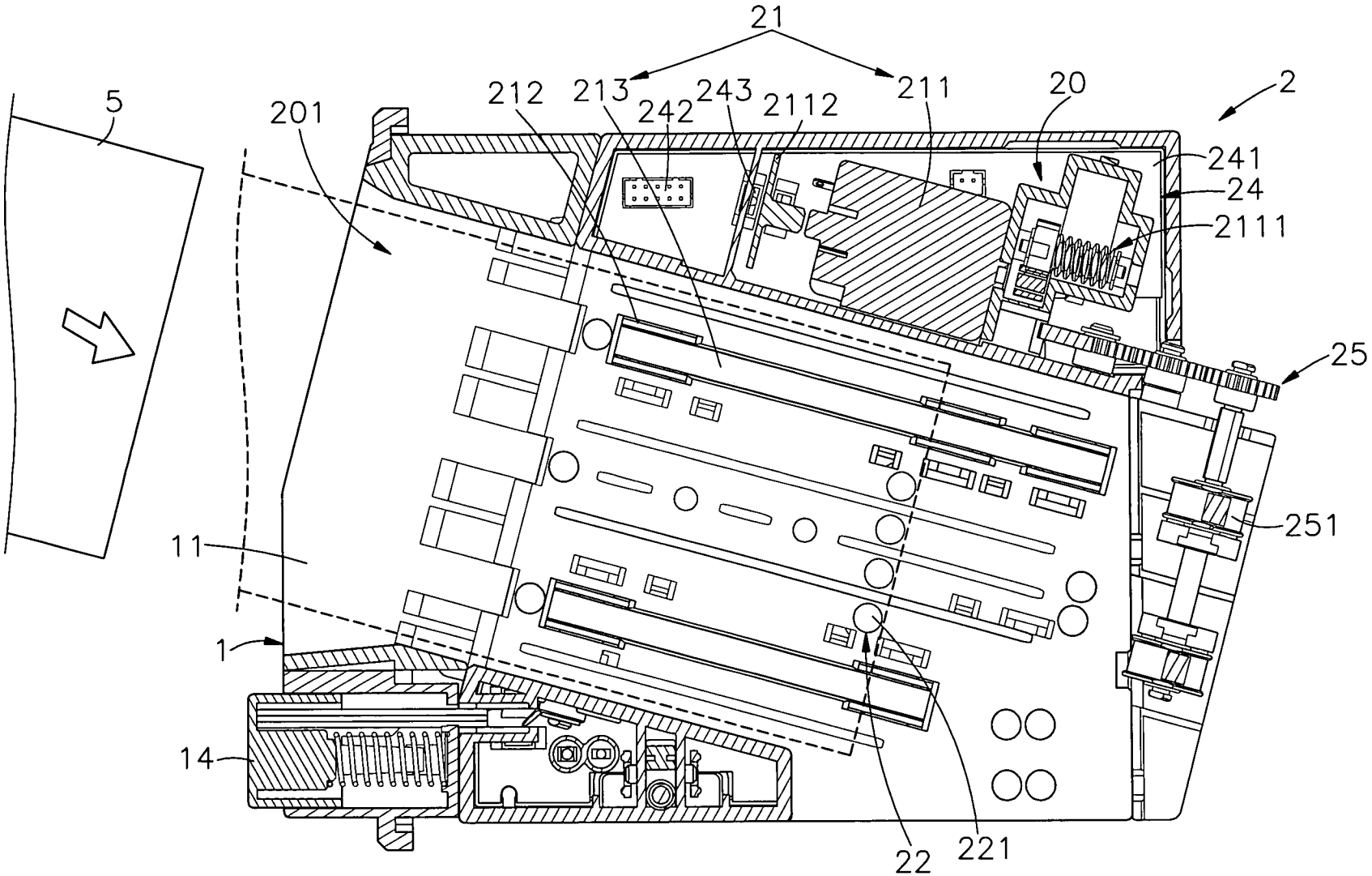
FIG. 5 is a schematic sectional side view of the bill and coin acceptor in accordance with the present invention.
Figure 6:
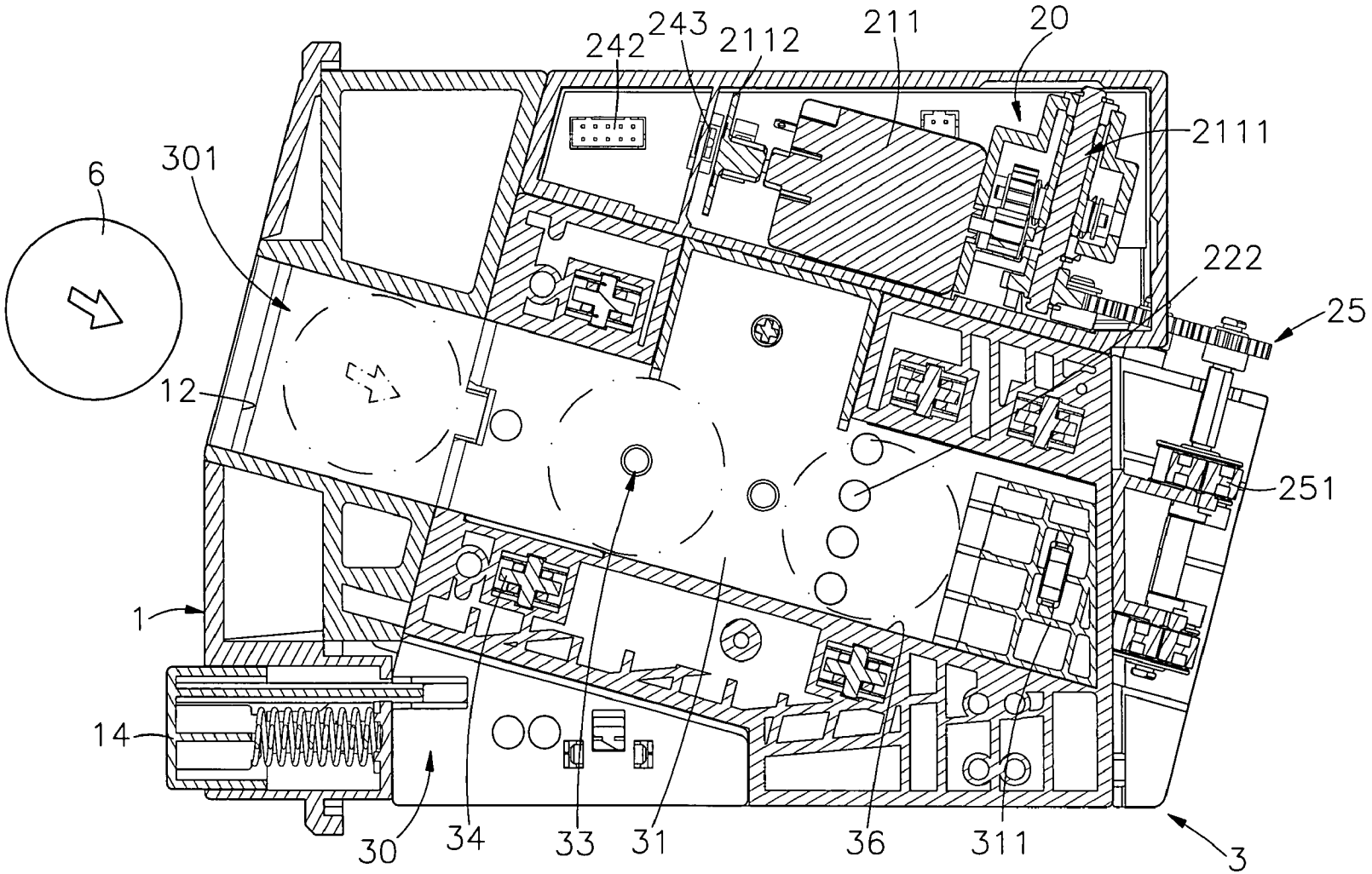
FIG. 6 is another schematic sectional side view of the bill and coin acceptor in accordance with the present invention.
Figure 7:
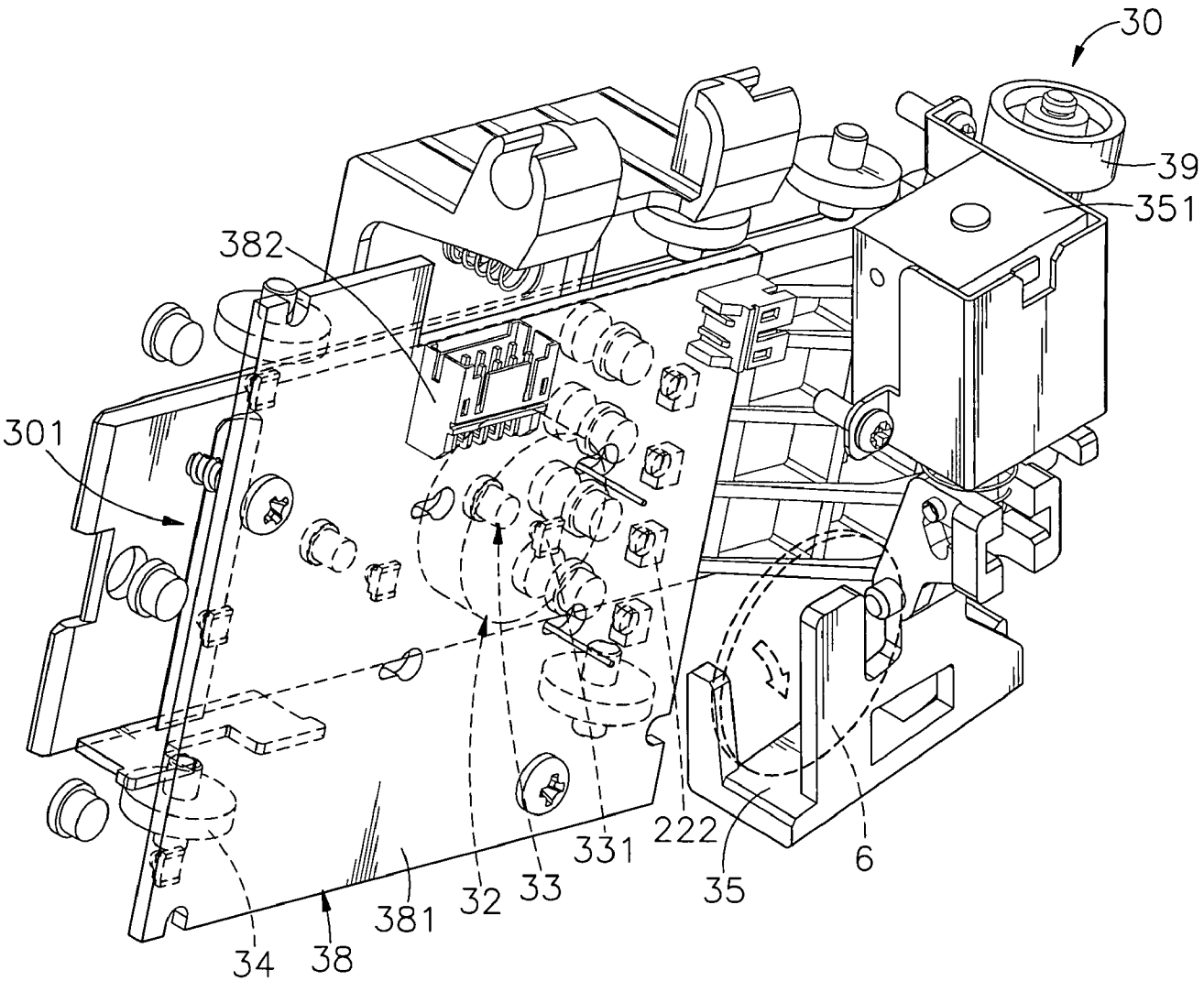
FIG. 7 is a perspective view of a part of FIG. 6.

In the bill and coin acceptor constructed according to the present invention, the power drive mechanism 21 and the bill recognition module 22 are mounted inside the first housing 2, and adapted for transferring each inserted bill 5 and recognizing the authenticity and value of each inserted bill 5 respectively; the bill passage 201 is defined between the first housing 2 and the second housing 3 for the passing of the inserted bill 5; the coin sensor module 32 and the optical recognition device 33 are mounted inside the second housing 3 in the coin passage 301 and adapted for sensing the authenticity and value of each inserted coin 6; the driven gear set 34 is arranged at the top and bottom sides of the coin passage 301 inside the second housing 3 and facing the drive gear set 212 of the power drive mechanism 21; the gate 35 mounted in the second housing 3 at the rear bottom side relative to the coin passage 301. Subject to the aforesaid arrangement, the invention integrates a bill acceptor and a coin acceptor into a single unit of bill and coin acceptor, fully utilizing the limited space. During installation, the bill passage 201 of the first housing 2 and the coin passage 301 of the second housing 3 are respectively kept in communication with the respective bill passage and coin passage in the host 4 for receiving bills 6 and coins 5 (see FIGS. 5 and 6). Therefore, the invention simplifies the design and fabrication of the whole system, and greatly widens its application range.

Referring to FIGS. 5~8, when the bill and coin acceptor is installed in a host 4 (that can be an automatic vending machine, game machine, consumer inquiry service system or the like), connect a electrical connector 242 of the circuit board 241 and a electrical connector 382 of the circuit board 381 to the matching electrical connectors (not shown) of the host 4. Thus, the bill and coin acceptor is electrically connected to the host 4 for receiving bills 5 and coins 6. Further, with respect to the designs of the control circuits at the circuit boards 241 and 381 and the operations how the control circuits at the circuit boards 241 and 381 work with the bill recognition module 22 and the coin sensor module 32 and optical recognition device 33 to control the power drive mechanism 21 in transferring a bill 5 or to move the gate 35 for receiving or returning a coin 6, they pertain to known techniques, and therefore no further detailed description in this regard is necessary.

When using the bill and coin acceptor, a bill 5 can be inserted into the bill slot 11 at the face panel 1. When a bill 5 is inserted into the bill slot 11, the motor 211 of the power drive mechanism 21 is started to rotate the drive gear set 212 and then the bill-transfer belts 213, thereby transferring the inserted bill 5 toward the inside of the bill passage 201. At the same time, the driven gear set 34 is moved to adjust the pitch of the bill passage 201 subject to the thickness of the inserted bill 5, facilitating forward transfer of the inserted bill 5. At this time, a light receiver 221 and light emitter 222 of the bill recognition module 22 that are set between the first housing 2 and the second housing 3 are operated to check the authenticity and value of the inserted bill 5. When the inserted bill 5 is recognized to be a counterfeit bill, the power drive mechanism 21 is reversed to transfer the inserted bill 5 back to the bill slot 11. If the inserted bill 5 is recognized to be a true bill, the power drive mechanism 21 keeps transferring the inserted bill 5 through the bill passage 201. Further, there is an anti-theft hook (not shown) mounted in the bill passage 201 to prevent an evil person from using a tool (iron wire, adhesive tape) to pull back the inserted bill 5, assuring high security. After the inserted bill 5 passed to the rear side of the bill passage 201, the bill-expelling wheel set 251 of the bill-expelling mechanism 25 work with the idle wheel set 39 to carry the inserted bill 5 into the corresponding passage in the host 4, enabling the inserted bill 5 to be pushed by a bill pressing-down device (not shown) into the inside of a bill storage box (not shown).

The motor 211 of the power drive mechanism 21 has its one end coupled to a transmission gear set 2111, which is meshed with the drive gear set 212 and the bill-expelling wheel set 251, and its other end mounted with an encoder wheel 2112. During operation of the motor 211, the encoder wheel 2112 is rotated with the motor 211 to let emitted light from a photo sensor 243 pass or to block the light, thereby producing a pulse signal for enabling the control circuit at the circuit board 231 to calculate the moving distance of the inserted bill 5. With respect to the operation how the control circuit detects the insertion of a bill 5 and controls the power drive mechanism 21 to transfer the bill 5, it is of the known art and not within the scope of the spirit of the present invention, and therefore no further detailed description in this regard is necessary.

Further, when a coin 6 is inserted into the coin slot 12 at the face panel 1, the coin 6 enters the coin passage 301. At this time, the light receiver 331 and light emitter 332 of the optical recognition device 33 are driven to detect the authenticity and value of the coin 6. When the coin 6 keeps moving downwardly forwards, the anti-theft hook (not shown) in the coin passage 301 is biased to the top side above the coin 6, preventing an evil person from using a tool to pull back the coin 6. The coin passage 301 slopes downwardly forwards to guide the coin 6 toward the coin sensor module 32. The coin sensor module 32 senses the authenticity and value of the coin 6 by means of magnetic induction, enhancing recognition accuracy.

After the coin 6 passed over the coin sensor module 32, it is guided by a guide 311 at the rear side of the partition board 31 to fall to the gate 35. The gate 35 may be configured to slope or curve in on direction. If the coin 6 is recognized to be a counterfeit coin, it will move along the coin-return passage 36 in front of the gate 35 toward the coin-return slot 13. If the coin 6 is recognized to be a true coin, the electromagnetic valve 351 will be driven to open the gate 15, for enabling the coin 6 to pass through the coin outlet 302 at the bottom side of the gate 15 and to fall to the corresponding internal passage in the host 4 toward a coin storage box (not shown).

In conclusion, the invention provides a bill and coin acceptor, which has the following advantages and features:

1. a first housing 2 that houses a bill-receiving module 20 and a second housing 3 that houses a coin-receiving module 30 are hinged together and then fastened to the back side of a face panel 1 to constitute a compact size bill and coin acceptor for use in a host 4, such as automatic vending machine or game machine, so that the host 4 can accept bills and coins.

2. The bill-receiving module 20 comprises a power drive mechanism 21 and a bill recognition module 22; a bill passage 201 is defined between the first housing 2 and the second housing 3; the coin-receiving module 30 comprises a coin sensor module 32 and an optical recognition device 33 respectively set in the coin passage 301, a driven gear set 34 arranged at the top and bottom sides relative to the coin passage 301 and facing the drive gear set 212 of the power drive mechanism 21, a gate 35 set at the rear bottom side relative to the coin passage 301 and movable between an open position and a close position by an electromagnetic valve 351. Thus, the bill-receiving module 20 and the coin-receiving module 30 are arranged in one same space structure, saving much the installation space.

3. During installation of the bill and coin acceptor, the bill passage 201 in the first housing 2 and the coin passage 301 in the second housing 3 are respectively attached to the corresponding internal passages of the host 4, enabling the host 4 to accept bills and coins. Thus, using the bill and coin acceptor in a host needs not to change the specifications of the host. Therefore, the invention simplifies the design and fabrication of the whole system, and greatly widens its application range.

4. The bill slot 11, coin slot 12 and coin-return slot 13 of the face panel 1 are respectively kept in communication with of the bill passage 201 of the first housing 2 and the coin passage 301 and coin-return passage 36 of the second housing 3. Thus, a bill 5 or coin 6 can be inserted into the bill and coin acceptor. When a bill or coin is inserted, the authenticity and value of the inserted bill or coin are recognized by the bill recognition module 22 of the bill-receiving module 20 or the coin sensor module 32 and optical recognition device 33 of the coin-receiving module 30. A counterfeit bill or coin will be returned to the bill slot 11 or the coin-return passage 36. Thus, the bill and coin acceptor can be used in a host 4 for unmanned operation and customer self service, saving much the management cost.

As stated above, the invention provides a bill and coin acceptor that comprises a first housing 2 that houses a bill-receiving module 20, a second housing 3 that houses a coin-receiving module 30 and hinged to the first housing 2, and a face panel 1 fastened to the first housing 2 and the second housing 3 at the front side. Thus, bill and coin acceptor has a compact size practical for use in a host 4, so that the host 4 can accept bills and coins.

The present invention having been thus described with particular reference to the preferred embodiment thereof, it will be obvious that various modifications and enhancements may be made therein without departing from the spirit and scope of the present invention as defined in the disclosure and the claims.

What the invention claimed is:

1. A bill and coin acceptor, comprising:

a face panel, said face panel comprising a bill slot, a coin slot disposed at one lateral side relative to said bill slot and a coin-return slot spaced below said coin slot;

a first housing fastened to said face panel, said first housing comprising a bill passage kept in communication with said bill slot, a power drive mechanism adapted for transferring an inserted bill from said bill slot through said bill passage, said power drive mechanism comprising a motor, a drive gear set coupled to and rotatable by said motor and a plurality of bill-transfer belts mounted on said drive gear set and rotatable by said drive gear set to transfer an inserted bill from said bill slot through said bill passage, and a bill recognition module adapted for recognizing the authenticity and value of a bill being inserted into said bill slot; and a second housing coupled to one lateral side of said first housing and fastened to said face panel, said second housing comprising a coin passage kept in communication with said coin slot, a coin sensor module and an optical recognition device respectively set in said coin passage and adapted for sensing the authenticity and value of a coin being inserted into said coin slot, a driven gear set arranged at top and bottom sides relative to said coin passage and facing said drive gear set of said power drive mechanism for assisting transfer of an inserted bill through said bill passage, a coin-return passage kept in communication with said coin-return slot, and a gate set in between said coin passage and said coin-return passage and movable to open the passage between said coin passage and said coin-return passage.

2. The bill and coin acceptor as claimed in claim 1, wherein said face panel further comprises a coin-release button.

3. The bill and coin acceptor as claimed in claim 1, wherein said first housing further comprises an outer cover covered on an outer side thereof, and a circuit board mounted inside said outer cover and carrying a control circuit electrically connectable to a host and adapted for controlling the operation of said bill recognition module.

4. The bill and coin acceptor as claimed in claim 1, wherein said first housing further comprises a bill-expelling mechanism disposed at a rear side thereof, said bill-expelling mechanism comprising a bill-expelling wheel set; said second housing further comprises an idle wheel set disposed adjacent to said bill-expelling wheel set and workable with said bill-expelling wheel set to carry an inserted bill out of said bill passage to an external host.

5. The bill and coin acceptor as claimed in claim 1, wherein said second housing further comprises a partition board disposed at an inner lateral side thereof in proximity to said first housing, and an electromagnetic valve mounted in between said partition board and said coin passage and adapted for moving said gate in opening the passage between said coin passage and said coin-return passage.

6. The bill and coin acceptor as claimed in claim 1, wherein said second housing further comprises an outer cover covered on an outer lateral side thereof, and a circuit board mounted inside said outer cover and carrying a control circuit electrically connectable to an external host and adapted for controlling the operation of said coin sensor module, said optical recognition device and said gate.

7. A bill and coin acceptor, comprising:

a face panel, said face panel comprising a bill slot, a coin slot disposed at one lateral side relative to said bill slot, a coin-return slot spaced below said coin slot and a coin-release button;

a first housing fastened to said face panel, said first housing comprising a bill-receiving module adapted for receiving an inserted bill from said bill slot, said bill-receiving module comprising a power drive mechanism adapted for transferring an inserted bill from said bill slot and a bill recognition module adapted for recognizing the authenticity and value of an inserted bill; and a second housing coupled to one lateral side of said first housing and fastened to said face panel and defining with said first housing a bill passage in communication with said bill slot, said second housing comprising a coin passage kept in communication with said coin slot, a coin-return passage kept in communication with said coin-return slot and a coin-receiving module, said coin-receiving module comprising a coin sensor module adapted for sensing the authenticity and value of an inserted coin;

wherein said second housing further comprises a partition board disposed at an inner lateral side thereof in proximity to said first housing, and a gate set in between said coin passage and said coin slot, a coin-return passage and movable to open/close the passage between said coin passage and said coin slot.

8. The bill and coin acceptor as claimed in claim 7, wherein said power drive mechanism comprises a motor, a drive gear set coupled to and rotatable by said motor and a plurality of bill-transfer belts mounted on said drive gear set and rotatable by said drive gear set to transfer an inserted bill from said bill slot through said bill passage; said coin-receiving module comprises a driven gear set arranged at top and bottom sides relative to said coin passage and facing said drive gear set of said power drive mechanism for assisting transfer of an inserted bill through said bill passage.

9. The bill and coin acceptor as claimed in claim 7, wherein said first housing further comprises an outer cover covered on an outer side thereof, and a circuit board mounted inside said outer cover and carrying a control circuit electrically connectable to an external host and adapted for controlling the operation of said bill recognition module.

10. The bill and coin acceptor as claimed in claim 7, wherein said first housing further comprises a bill-expelling mechanism disposed at a rear side thereof, said bill-expelling mechanism comprising a bill-expelling wheel set; said second housing further comprises an idle wheel set disposed adjacent to said bill-expelling wheel set and workable with said bill-expelling wheel set to carry an inserted bill out of said bill passage to an external host.

11. The bill and coin acceptor as claimed in claim 7, wherein said coin-receiving module further comprises an electromagnetic valve adapted for moving said gate in opening the passage between said coin passage and said coin-return passage.

12. The bill and coin acceptor as claimed in claim 7, wherein said coin-receiving module further comprises an optical recognition device adapted for recognizing the authenticity and value of an inserted coin.

13. The bill and coin acceptor as claimed in claim 7, wherein said second housing further comprises an outer cover covered on an outer lateral side thereof, and a circuit board mounted inside said outer cover and carrying a control circuit electrically connectable to an external host and adapted for controlling the operation of said coin sensor module.

* * * * *